US005589726A

United States Patent [19]

Gold

[11] Patent Number: 5,589,726

[45] Date of Patent: Dec. 31, 1996

[54] ARC LAMP WITH EXTERNAL MAGNETIC MEANS

[75] Inventor: Ronald S. Gold, Fullerton, Calif.

[73] Assignee: Hughes Aircraft Company, Los Angeles, Calif.

[21] Appl. No.: 533,724

[22] Filed: Sep. 25, 1995

Related U.S. Application Data

[63] Continuation of Ser. No. 171,289, Dec. 21, 1993, abandoned.

[51] Int. Cl.[6] ..... H01J 1/50

[52] U.S. Cl. ..... 313/161; 313/157; 315/344

[58] Field of Search ..... 313/161, 157, 313/156, 113; 315/344

[56] References Cited

U.S. PATENT DOCUMENTS

| | | | |
|---|---|---|---|
| 3,028,491 | 4/1962 | Schleich | 313/161 |
| 3,113,234 | 12/1963 | Schlegel | 313/161 |
| 3,378,713 | 4/1968 | Ludwig | 313/157 |
| 3,453,481 | 7/1969 | Schimmelpfennig | 313/156 |
| 3,860,335 | 1/1975 | Caprari | 353/102 |
| 3,881,132 | 4/1975 | Miller | 313/161 |
| 3,988,626 | 10/1976 | Boudouris | 313/161 |
| 4,069,416 | 1/1978 | Suga | 313/161 |
| 4,720,660 | 1/1988 | Whelan | 315/344 |
| 5,260,815 | 11/1993 | Takizawa | 353/31 |

*Primary Examiner*—Brian Zimmerman
*Assistant Examiner*—Michael Day
*Attorney, Agent, or Firm*—G. S. Grunebach; M. W. Sales; W. K. Denson-Low

[57] ABSTRACT

The present invention provides an arc lamp for producing a high intensity point source of light by magnetically compressing the light emitting element of the arc lamp. Arc lamp point light source 30 includes bulb 32 having two electrode 34, 36 spaced apart to have gap 35 therebetween and hermetically sealed within bulb envelope 44 filled with ionizing gas. Connector 46 is provided for applying a voltage potential across electrodes 34, 36 causing electric current to pass therebetween to generate arc plasma 42. Annular magnet 48 and bar magnet 50 located outboard of bulb envelope 44 generate a magnetic field around arc plasma 42 to compress the volume thereof between electrodes 34, 36.

14 Claims, 2 Drawing Sheets

ARC LAMP WITH EXTERNAL MAGNETIC MEANS

This is a continuation application Ser. No. 08/171,289, filed Dec. 21, 1993, now abandoned.

BACKGROUND OF THE INVENTION

1. Field of the Invention

The present invention relates to a point or near point light source for use in a projection display application, and more particularly to a xenon arc bulb having a magnetic field generated around the bulb envelope to compress the arc plasma therein.

2. Description of Related Art

Arc lamps are a type of electric-discharge lamp in which an electric current flows between two electrodes which are placed in a gas or vapor environment. The light emitted from these lamps is produced from the luminescence of the gas resulting from the increased energy state caused by the current passing therethrough. This energized gas between the electrodes is referred to as the arc plasma. A special type of arc lamp is the xenon arc lamp which typically incorporates two electrodes enclosed in a fused quartz bulb filled with xenon gas at a pressure above atmospheric pressure. The light emitted from a xenon arc bulb is substantially continuous throughout the visible spectrum and approximates daylight in color. Another advantage of xenon arc bulbs is that they are capable of producing a high intensity light. For these reasons xenon arc bulbs are used to artificially illuminate objects in light valve-based and film-based projection display systems, fiber optics networks, as well as solar simulation systems.

However, as electronics and optics have become increasingly smaller, the existing arc lamps have proven to be bulky and/or inefficient. In addition, much of the light generated by these light sources cannot be directed into or collected by the smaller components because of their size; instead it must be absorbed by the bulb or surrounding components where it generates unwanted heat. In addressing these problems a series of optical components have been employed to focus, direct and collimate the light. However, these additional components are counterproductive to the miniaturization of these systems since they add size and cost of the systems. Accordingly, there is a need to provide a smaller light source which does not sacrifice brightness or intensity.

SUMMARY OF THE INVENTION

In accordance with the teachings of the present invention an arc lamp is provided that produces a high intensity source of light by reducing or compressing the arc plasma, the light emitting element of the arc lamp. The present invention includes a bulb having two electrodes spaced apart and defining a gap therebetween. The electrodes are hermetically sealed within a bulb envelope which is filled with ionizing gas. A connector is provided for applying a voltage potential across the electrodes to enable electric current to pass between the electrodes and generate an arc plasma. The present invention further includes a magnetic field means located outboard of the bulb envelope for generating a magnetic field around the arc plasma. This magnetic field acts on the arc plasma to compress the volume thereof in the inter-electrode region. As a result of the reduction in volume of the arc plasma, a higher intensity light source is produced than a bulb of equal power having an uncompressed arc plasma. The high intensity of light from the compressed arc plasma affords greater collection efficiency of the energy emitted. As a result the point light source enhances performance for projection display systems which incorporate the light source independent from the object source, fiber optic networks and solar simulation systems.

BRIEF DESCRIPTION OF THE DRAWINGS

The various advantages of the present invention will become apparent to those skilled in the art after a study of the specification and by reference to the drawings in which.

DESCRIPTION OF THE PREFERRED EMBODIMENT

Figure 1:
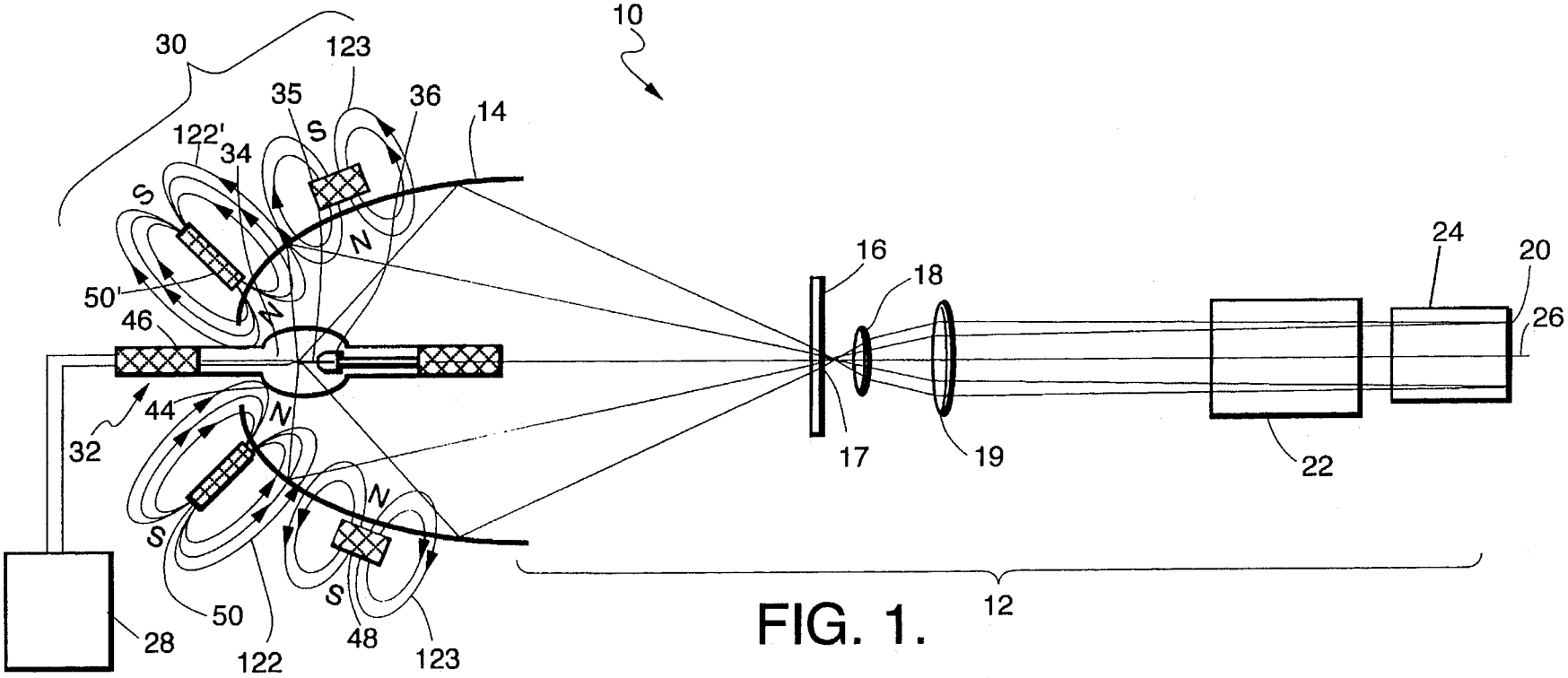
FIG. 1 is a schematic representation of the catadioptric collection and relay optics for a projection display system which incorporates the present invention.

It should be understood from the outset that the present invention will be described in connection with a specific embodiment which illustrates the best mode of practicing the invention known at the time that this application was filed. However, various modifications will become apparent to those skilled in the art after having the benefit of studying the text, drawings and claims which follow. With that caveat in mind, the attention of the reader should now turn to the drawings, with particular reference to FIG. 1.

In accordance with the preferred teachings of this invention, projection display system 10 is provided for generating and displaying an image. Projection display system 10 includes power supply 28 for energizing projection display system 10 coupled to point light source 30 and optical elements 12 disposed along an optical axis 26. In this embodiment, light is generated and emitted from point light source 30 and projected along optical axis 26 where it encounters a plurality of optical elements 12 which format the light emitted from point light source 30 to generate and display an image.

More particularly, point light source 30 includes bulb 32 having two electrodes, cathode 34 and anode 36, disposed and hermetically sealed within bulb envelope 44. Connector 46 provides an electrical connection between power supply 28 and electrodes 34, 36 such that a voltage potential may be applied across electrodes 34, 36 without disrupting the environment within bulb envelope 44. While the embodiment displayed in FIG. 1 and described herein contemplates utilizing a direct current power supply source, one skilled in the art would readily appreciate that an alternating current power supply could be substituted therefor without deviating from the scope of the present invention.

Point light source 30 further includes annular magnet 48 located about optical axis 26 and partially surrounding bulb 32 opposite optical elements 12. Annular magnet 48 is also located so as to minimize its light blocking affects and magnetic interference with surrounding components. A pair of bar magnets 50, 50' are producing magnetic fields 122, 122', respectively located within the vicinity of annular magnet 48 to adjust and refine the magnetic field 123 generated by annular magnet 48 to the desired configuration. As illustrated in FIG. 1 a permanent magnet has been utilized for annular magnet 48 and magnets 50, 50'. However, an electromagnet or any other means for producing the desired magnetic field could be incorporated into the present invention to achieve the desired result.

Figure 2:
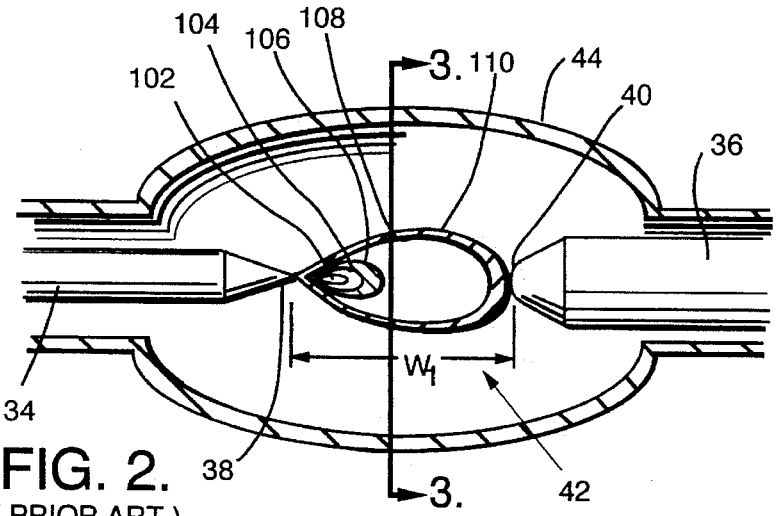
FIG. 2. ( PRIOR ART )
FIG. 2 is an enlarged view of the electrode portion of a standard arc lamp having an uncompressed volume of arc plasma, the resulting iso-brightness contour lines of the uncompressed arc plasma being shown as known in the prior art.
Figure 3:
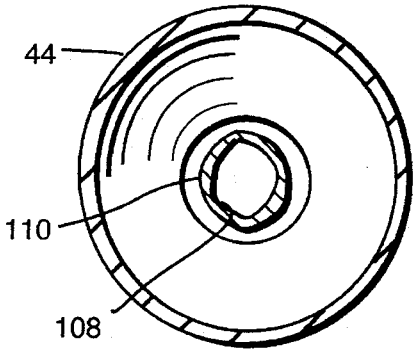
FIG. 3 is a cross-sectional view of the uncompressed arc plasma shown in FIG. 2 as known in the prior art.

Referring now to FIGS. 2 and 3, a portion of bulb 32 is shown enlarged including cathode 34 and anode 36 spaced apart and defining gap 35 therebetween gap 35 having a width W1. Bulb envelope 44 encloses cathode 34 and anode 36 to provide a hermetically sealed environment around these electrodes and is filled with ionizing gas, typically xenon.

In operation, a voltage potential generated by power supply 28 is applied across electrodes 34 and 36, thereby causing a current flow across gap 35 having width W1. This current flow charges the ionizing gas particles in gap 35 between these electrodes, thus increasing their energy state and generating arc plasma 42. These energized ions generate and emit light from bulb 32. The volume of arc plasma 42 is defined longitudinally by current emitting area 38, where the electrical current arc originates from cathode 34, and current collecting area 40, where the electrical current arc terminates at anode 36, and radially by the boundary where the ionizing gas particles are in an unenergized state as shown by iso-brightness line 110. Arc plasma centroid 43 is located at the center of mass of arc plasma 42 near current emitting area 38. The uncompressed volume of arc plasma 42 is best illustrated in FIGS. 2 and 3 by the iso-brightness contour lines 102, 104, 106, 108 and 110, iso-brightness contour line 102 being the brightest contour line and iso-brightness contour line 110 being the dimmest contour line and the outer boundary of arc plasma 42. FIG. 2 illustrates a standard arc lamp, such as the commercially available, 2500 watt xenon arc lamp made by Hanovia, part no. 995C0010, in which the arc plasma between electrodes 34 and 36 is in an uncompressed state.

Figure 5:
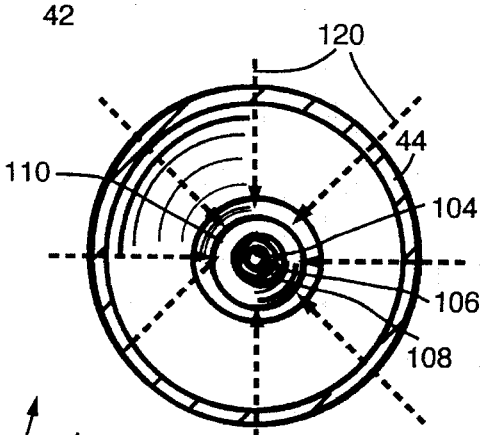
FIG. 5 is a cross-sectional view of the compressed arc plasma shown in FIG. 4.
Figure 4:
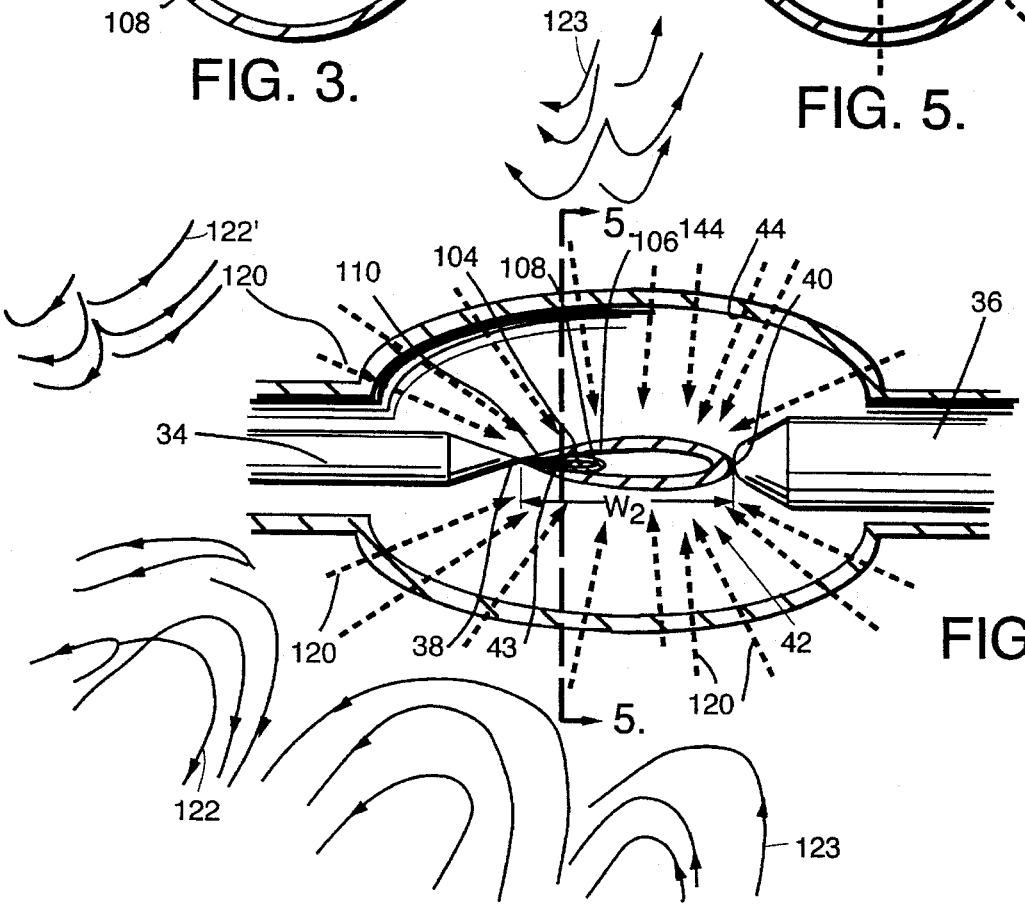
FIG. 4 is an enlarged view of the electrode portion of an arc lamp having a surrounding magnetic field being illustrated by solid lines which compresses the volume of arc plasma to approximately one-half the uncompressed volume, the the magnetic lines of force of magnetic field being illustrated by the dotted vectors and the resulting iso-brightness contour lines of the compressed arc plasma being shown.

Referring now to FIGS. 4 and 5, a presently preferred bulb is shown which has been modified from the standard bulb shown in FIG. 2 for the present invention. Point light source 30 is shown wherein a magnetic field acts upon arc plasma 42 to compress the volume thereof. The magnetic field as represented by magnetic lines of force 120 generated by annular magnet 48 and magnets 50 shown in FIG. 1. Magnetic lines of force 120 act upon arc plasma 42 in a substantially radial direction as can be best seen in FIG. 5 and magnetic lines of force 120 act upon arc plasma 42 in a substantially longitudinal direction as can best be seen in FIG. 4. Furthermore, the magnetic field may be generated such that magnetic lines of force 120 converge on arc plasma centroid 43 to compress arc plasma 42 thereto.

Arc plasma 42 includes current emitting area 38 which is in contact with cathode 34 and current collecting area 40 which is in contact with anode 36. The maximum possible current capable of flowing between electrodes 34 and 36 short of melting them is determined by size of these areas. To preserve the integrity of electrodes 34 and 36, current emitting area 38 and current collecting area 40 should not be reduced in size when arc plasma 42 is compressed. Thus, the magnetic fields imposed on arc plasma 42 must not compress or quench current emitting area 38 or current collecting area 40.

In its preferred embodiment, the present invention contemplates compressing the overall volume of arc plasma 42 of bulb 32 to approximately 50% of the uncompressed arc plasma volume. In order to achieve an overall 50% compression of arc plasma 42 and still maintain the above-described area requirements, the volume of arc plasma 42 in gap 35 having width W2 may be locally reduced by as much as fourfold.

As previously described, it is desirable to incorporate a bulb which has been modified for arc plasma compression. Bulb 32 may include a modified electrode gap spacing, electrode shape and surface contour to facilitate the generation of a compressed arc plasma. As shown in FIG. 4, electrodes 34 and 36 are located substantially closer together than electrodes 34 and 36 shown in FIG. 2. The width W2 is considerably smaller than the width W1. The physical size of bulb envelope 44 may be reduced as a result of the compressed volume of arc plasma 42 and the closer spacing W2 of electrodes 34, 36. In addition, a concave or focusing electrode shape could be employed to facilitate arc plasma compression. Furthermore, the electrode surface could be shaped to ensure that the flux lines of the magnetic field intersect the electrode surface in a substantially perpendicular manner.

Additional modifications to bulb 32 could include a modified ionizing gas constituent and pressure, as well as a unique bulb envelope geometry to locate the magnets around the arc plasma. The Hanovia bulb identified above is filled with xenon gas so that its cold fill pressure is approximately three (3) atmospheres. In a preferred embodiment the fill pressure of bulb 32 would be determined on the basis of the ease of arc ignition, the desired temperature of the arc near bulb envelope 44, expected bulb lifespan, and efficacy of radiation of arc plasma 42. Compression of arc plasma 42 and the accompanying increase in the current density will change the energy balance in gap 35. If the temperature inside bulb envelope 44 increases, the opacity will be different. Thus, a different fill pressure may be required to achieve the desired radiation.

Similarly, the radiation from bulb 32 is a function of the ionizing gas used to fill bulb envelope 44. The selection of the gas has a direct effect on the spectral characteristics, brightness, bulb lifespan and threshold ignition voltage for bulb 32. Accordingly, it may be desirable to add other constituents to the presently preferred xenon gas fill which will alter these characteristics. For example, xenon gas fills which contain a proper doping may be incorporated to achieve the desired bulb characteristic, such as mercury, krypton or other constituents presently used in xenon arc lamps.

Referring again to FIG. 1, a variety of optical elements 12 are incorporated into projection display system 10 to collect light emitted from point light source 30 and direct it towards image plane 20. More particularly, concave mirror 14 which may be parabolic, conic or concave asphere in shape is a reflective element which collects light not emitted directly towards image plane 20 and directs it thereto. In a preferred embodiment, concave mirror 14 is fabricated out of electroformed nickel which is coated with a highly reflective material such as aluminum or custom dichroic material as is commonly utilized in arc lamp illumination systems. Light which is projected down optical axis 26 via point light source 30 or concave mirror 14 impinges on stop 16 to appropriately format the light.

The light which is transmitted along optical axis 26 and within the dimensions of aperture 17 in stop 16 is transmitted therethrough to the remaining optical elements. The balance of the light transmitted to stop 16 is blocked from further transmission along optical axis 26. Lenses 18 and 19 are interposed along optical axis 26 to further format the light. For example, biconvex lens 18 is employed to magnify the light transmitted through aperture 17, while collimating lens 19 formats the light such that it is transmitted substantially parallel to optical axis 26 towards image plane 20. Lenses 18 and 19 further act to filter out undesirable energy. For example, in a liquid crystal light valve based projection display system, these elements would filter out ultraviolet energy and heat-generating infrared energy which could damage the liquid crystal material contained in the light valve. Similarly, prism 22 and light valve 24 are located along optical axis 26 and serve to appropriately format the light transmitted thereto for displaying an image.

Projection display system 10 has been described in general terms. Detailed descriptions of various projection display systems can be found in the following patents, including U.S. Pat. No. 4,650,286 entitled "Liquid Crystal Light Valve Color Projector" issued on Mar. 17, 1987 to Koda et al.; and U.S. Pat. No. 4,127,322 entitled "High Brightness Full Color Image Light Valve Projection System" issued Nov. 28, 1978 to Jacobson, et al. which are incorporated herein in their entirety by reference.

One skilled in the art would readily recognize that the xenon arc lamp point light source of the present invention could be readily adapted into most projection display systems incorporating a separate light source from the object source. In addition, while projection display system 10 described above and illustrated in FIG. 1 shows point light source 30 disposed parallel to optical axis 26, one skilled in the art would readily recognize that in some embodiments it may be preferred to orient point light source 30 perpendicular to optical axis 26. Thus, the present invention contemplates an embodiment which enables the light source to be oriented in an optimal orientation relative to optical axis 26. Furthermore, one skilled in the art would readily appreciate that the present invention is not limited to use in the above described systems but may be incorporated into any existing projection system which uses a separate light source, including light valve based and film based projector systems. Commercial examples of such systems are the Hughes HJT projectors and the Hughes-Fullerton large screen projectors.

From the foregoing, those skilled in the art should realize that the present invention provides a high intensity point light source by utilizing magnetic elements to generate a magnetic field which acts upon the arc plasma within an arc lamp to compress the volume of the arc plasma. As noted from the outset, the invention has been described in connection with a few particular examples. However, various modifications and other applications will become apparent to those skilled in the art after having the benefit of studying the specification, drawings and the following claims.

What is claimed is:

1. An arc lamp point light source comprising:

a bulb for generating and emitting a light source including a first and a second electrode having a gap therebetween, the electrodes being enclosed and hermetically sealed in bulb envelope filled with an ionizing gas;

connector means for applying a voltage potential across the electrodes to generate an arc plasma having an arc volume and an arc centroid in the gap when electric current passes between the first and second electrodes; and magnetic field means located outboard of the bulb envelope for generating at least two magnetic fields, the magnetic fields operable to produce lines of force, for converging the arc plasma toward the arc centroid, wherein said magnetic field means comprises a first magnetic field means for spherically symmetrically compressing the volume of the arc plasma between the first and second electrodes, and a second magnetic field means for adjusting the magnetic field generated by the first magnetic field means.

2. The arc lamp point light source of claim 1 wherein the first electrode is a cathode and the second electrode is an anode, wherein the gap therebetween the cathode and the anode is reduced by approximately a power of four.

3. The arc lamp point light source of claim 1 wherein the magnetic field means producing the lines of force converging the arc plasma towards the arc centroid spherically symmetrically compresses the arc plasma, thereby reducing the arc plasma volume approximately fifty percent.

4. The arc lamp point light source of claim 1 wherein magnetic field means generates lines of force which compress the arc plasma in a symmetrical substantially radially inward direction.

5. The arc lamp point light source of claim 1 wherein the arc plasma has a first emitting area in contact with the first electrode and a second emitting area in contact with the second electrode; and wherein the magnetic field means generates lines of force which do not symmetrically compress the arc plasma at the first and second emitting areas.

6. The arc lamp point light source of claim 1 wherein the ionizing gas is xenon.

7. The arc lamp point light source of claim 1 wherein the magnetic field means comprises an annular magnet located outboard of the bulb envelope.

8. The arc lamp point light source of claim 7 wherein the magnetic field means further comprises an additional magnet located outboard of the bulb envelope for adjusting the magnetic field generated by the annular magnet.

9. A projection display system for displaying an image, the projection display system comprising:

light source means for producing and emitting a point light source including a first electrode and a second electrode with a gap therebetween, the first and second electrodes being enclosed and hermetically sealed in bulb envelope filled with an ionizing gas, connector means for applying a voltage potential across the electrodes to generate an arc plasma having an arc volume and an arc centroid in the gap when electric current passes therebetween, and magnetic field means external to the bulb envelope for generating a multiplicity of magnetic fields around the arc plasma, the magnetic fields producing lines of force which radially converge toward the arc centroid, wherein said magnetic field means comprises a first magnetic field means for spherically symmetrically compressing the volume of the arc plasma between the electrodes, and a second magnetic field means for adjusting the magnetic field generated by the first magnetic field means;

power source means coupled to the connector means for producing a voltage potential across the electrodes such that electric current flows therebetween to generate the arc plasma;

light collection means for collecting the light emitted from the light source means and directing the light along an optical axis towards an image plane opposite the light source means; and image display means located at the image plane for generating the image, receiving the light projected thereto and illuminating and displaying the image.

10. The projection display system of claim 9 wherein the light source means is parallel to the optical axis of the light collection means.

11. The projection display system of claim 9 wherein the light source means is perpendicular to the optical axis of the light collection means.

12. The projection display system of claim 9 wherein the light collection means comprises a reflector located behind the light source means opposite the image plane.

13. The projection display system of claim 9 wherein the light collection means further comprises a stop disposed along the optical axis between the light source means and the image plane for formatting light emitted from the light source means.

14. The projection display system of claim 9 wherein the image display means comprises a prism and light valve.

* * * * *